United States Patent [19]

Grabbe et al.

[11] Patent Number: 4,653,840

[45] Date of Patent: Mar. 31, 1987

[54] ELECTRICAL CONNECTIONS FOR SHIELDED COAXIAL CONDUCTORS

[75] Inventors: Dimitry G. Grabbe, Middletown; Lahman D. Lambert, II, Mechanicsburg, both of Pa.

[73] Assignee: AMP Incorporated, Harrisburg, Pa.

[21] Appl. No.: 876,529

[22] Filed: Jun. 20, 1986

[51] Int. Cl.[4] ..... H01R 17/18

[52] U.S. Cl. ..... 339/177 R; 339/244 R; 339/143 R

[58] Field of Search ..... 339/177 R, 177 E, 244 R, 339/244 UC, 17 F, 143 R, 143 C; 174/75 C, 88 C

[56] References Cited

U.S. PATENT DOCUMENTS 3,441,659 4/1969 Laudig et al. ..... 174/88 C
3,804,972 4/1974 Gommans et al. ..... 174/88 C

FOREIGN PATENT DOCUMENTS 1159574 9/1955 France ..... 174/88 C
882487 11/1961 United Kingdom ..... 174/88 C

*Primary Examiner*—Gil Weidenfeld
*Assistant Examiner*—David Pirlot
*Attorney, Agent, or Firm*—F. W. Raring

[57] ABSTRACT

The ends of shielded coaxial conductors are connected to each other by a housing assembly comprising two or more housing blocks. The housing blocks have mating faces which are opposed to, and against, each other. The conductors are prepared by stripping the insulation and the shielding from the end and stripping the insulation only from an adjacent portion of each conductor. The stripped ends are in overlapping relationship and are pressed against each other by compressed blocks of plastic material. The plastic compresing blocks are held against the conductors by compressing bars which in turn are urged against the compressing blocks by a compressed elastomeric material. The dielectric constant of the plastic compressing blocks and the spacing between the overlapping stripped ends of the conductors and the surfaces of the compressing bars are selected such that the impedance in the zone of the electrical connection is compatible with the impedance of the cables.

19 Claims, 11 Drawing Figures

ELECTRICAL CONNECTIONS FOR SHIELDED COAXIAL CONDUCTORS

FIELD OF THE INVENTION

This invention relates to electrical connections for shielded coaxial conductors and particularly to conductors having an extremely small diameter of the type coming into use in high speed computers.

BACKGROUND OF THE INVENTION

A shielded coaxial conductor of the type widely used in computers comprises a central conducting core, a sheath of insulating material in surrounding relationship to the core, and a metallic shielding layer in surrounding relationship to the insulation. The shielding layer shields the signals transmitted in the central conductor as its name implies. However, the introduction of the shielding layer requires that the entire conductor must be manufactured with a high degree of precision for the reason that the conductor must have a precisely predetermined impedance Z in order that this quantity can be taken into account in the equipment in which it is used. The impedance is determined by the distance between the central conductor and the shielding layer and the dielectric constant of the insulating material.

The connecting devices used to connect the ends of shielded coaxial conductors to each other must go beyond the mere function of connecting the conducting cores and the shielding layers to each other in separate electrical connections They must also have an impedance which is compatible with the impedance of the cables being connected. If there is a mismatch of impedance between the connection and the impedance of the cables being connected, unpredictable and detrimental effects will result which can frustrate the purpose of the apparatus in which the conductors are used. For example, renegade signals or pulses can be caused by reflection due to an impedance mismatch and these pulses can interfere with the transmission of the intended distorted signals through the cable and in an extreme case can be interpreted as true signals in a distant part of the equipment and thereby completely frustrate its function.

The impedance mismatch problem has been solved for the relatively larger diameter shielded coaxial conductors which have heretofore been used. Usually, the connecting devices comprise pin and socket type connections for both the central core and the shielding material and such devices can be designed to produce acceptable impedance characteristics in the connection. However, future generations of electronic equipment will require shielded conductors of a much smaller diameter than the diameters of the cables or conductors presently used. A conductor is presently being manufactured which has an outside diameter of 0.008 inches (0.2 mm) with the core having a diameter of 0.002 inches (0.05 mm). The known types of connecting devices for shielded coaxial conductors which usually have a diameter of 0.2 inches or more cannot possibly be used for these extremely fine shielded coaxial conductors which are now being designed into future generations of computers. It is simply impossible, as a practical matter, to design a pin and socket type connecting device where the diameter of the central core of the conductor is only 0.05 mm and the outside diameter including the shielding is 0.2 mm.

The present invention is directed to the achievement of electrical connecting devices for shielded coaxial conductors having extremely fine diameters, for example, having an outside diameter of 0.008 inches as noted above. The achievement of this object requires an approach to the problem which is entirely unlike that of known types of pin and socket connectors for shielded coaxial conductors.

THE INVENTION

The invention comprises an electrical connection between a first shielded coaxial conductor and a second shielded coaxial conductor. Each of the conductors has a circular cross section and comprises a central conducting core, an insulating layer in surrounding relationship to the core, and a metallic shielding layer in surrounding relationship to the insulating layer. Each of the conductors has a stripped end portion from which the metallic shielding layer and the insulating layer have been removed so that the central core is exposed. Each of the conductors also has an unshielded portion from which the shielding layer has been removed so that the insulating layer is exposed, the unshielded portion being next adjacent to the stripped end portion. Each of the conductors has the same characteristic impedance Z which is a function of the distance d between the central core and the shielding layer and also a function of the dielectric constant of the insulating layer. The electrical connection is characterized in that the shielded conductors are in axial alignment with each other and extend towards each other with the stripped end portions being in overlapping parallel relationship and being against each other in a connecting zone. The end portions are surrounded by compressed insulating material, the end portions being pressed against each other by the insulating material and the compressed insulating material is maintained in its compressed condition by a compressing means in the connecting zone. The compressing means has opposed parallel conductive surface portions on opposite sides of the axes of the stripped ends so that the compressed insulating material is between the opposed conductive surface portions and the overlapping stripped end. Housing means are provided in surrounding and enclosing relationship to the connecting zone and in surrounding relationship to portions of the first and second conductors. The housing means has metallic shielding surface portions which are in electrical contact with the metallic shielding layers of the first and second conductors and in electrical contact with the parallel conductive surface portions thereby to provide electrical continuity between the shielding layers of the first and second conductors. The compressed insulting material has a thickness d' and the compressed insulating material has a predetermined dielectric constant. This dielectric constant and the thickness of the compressed insulating material, d', are preselected to produce a characteristic impedance in the connecting zone which is compatible with the characteristic impedance Z of the first and second conductors.

THE DRAWING FIGURES

THE DISCLOSED EMBODIMENT

Figure 5:
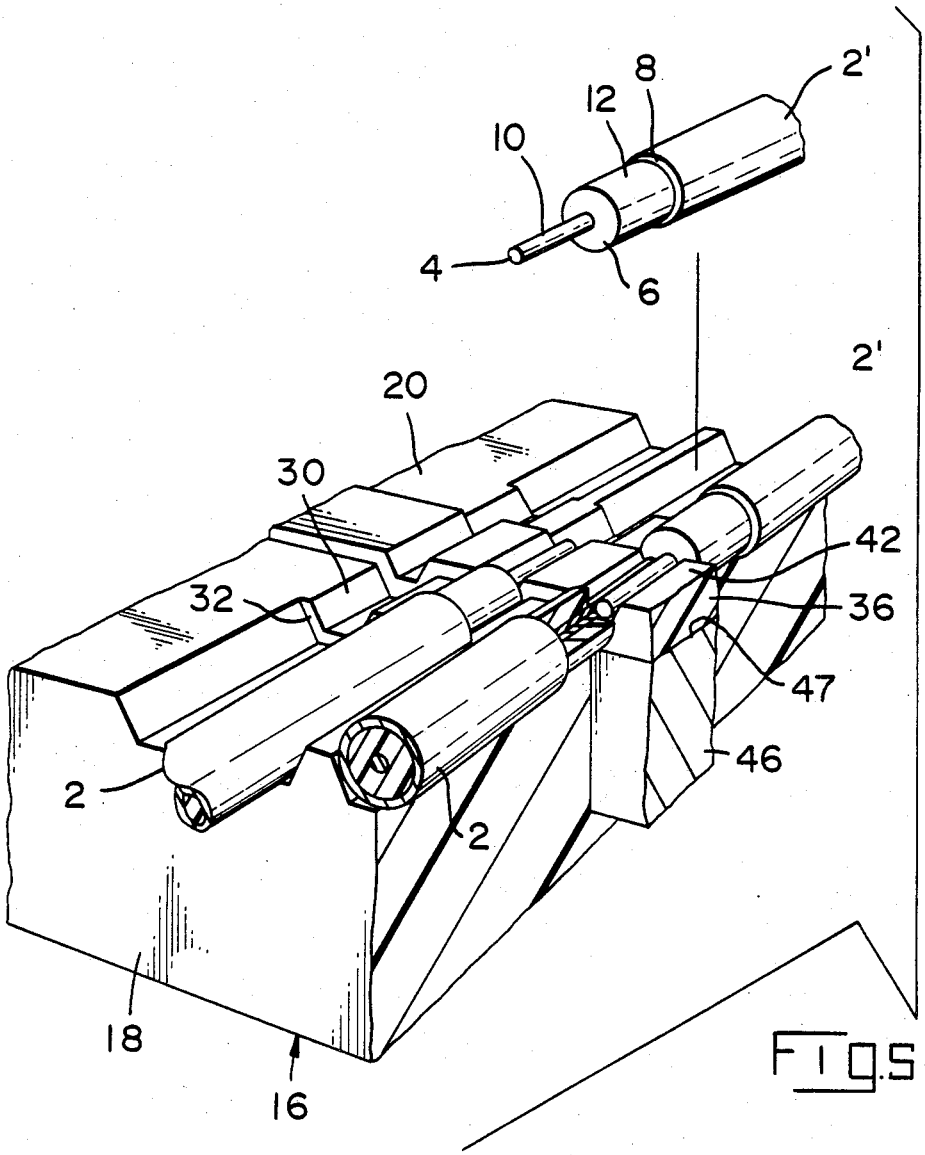

FIG. 5 shows the structure of coaxial conductors 2 of the type for which the connecting device of the invention is intended. Each coaxial shielded conductor comprises a central conducting core 4, insulating material 6 in surrounding relationship to the core, and metallic shielding 8 on the surface of the insulating material. When the conductors are prepared for use, the insulating material and the shielding are stripped from an end portion of each conductor to produce a stripped end 10. The shielding only is stripped from an adjacent portion to produce an unshielded portion 12.

Shielded conductors of the type shown are now being manufactured having an outside diameter of 0.008 inches (0.2 mm) with the diameter of the core 4 being 0.002 inches (0.05 mm). The conducting core 4 may be plated with a thin gold plating to provide a low resistance path for very high speed signals. The signals will move along the surface due to the "skin effect". It should be mentioned that the central core can also be a glass fiber having a metallized gold surface along the surface of the core. The insulating material 6 is preferably of a material having the properties of Teflon (polytetrafluoroethylene). The shielding material is applied to the surface of the insulating material by plastic metallization techniques or by other means. Notwithstanding its extremely small diameter, shielded conductors of the type shown are produced with a high degree of precision so that their characteristic impedance is predictable and is constant. It follows, that the connecting device must have a characteristic impedance Z' which is compatible with the impedance Z of the cable.

Figure 1:
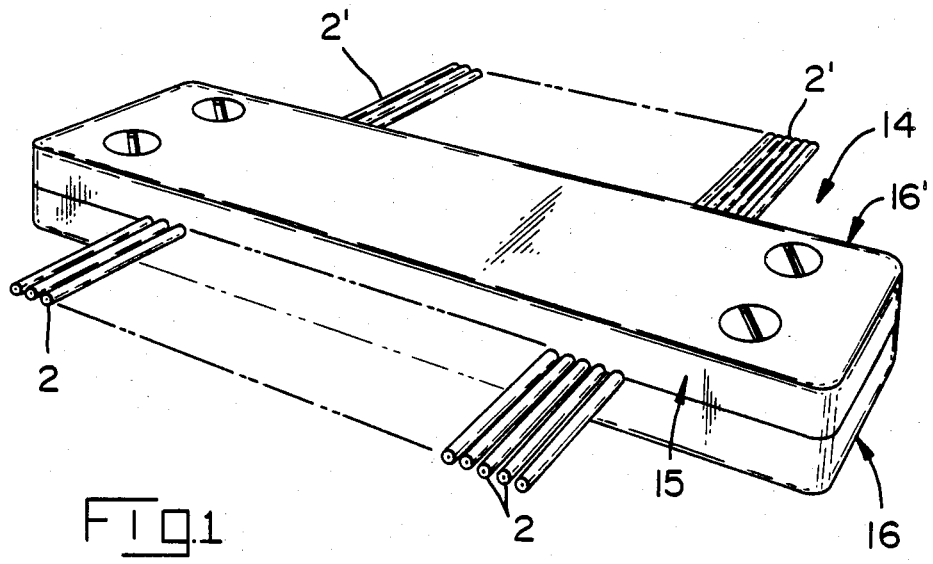
FIG. 1 is a perspective view of an assembly in accordance with the invention for connecting a first group of shielded coaxial conductors to a second group of shielded coaxial conductors.

The connecting device comprises a housing assembly 14, FIG. 1, having oppositely facing conductor entry side surfaces 15 into which a plurality of cables 2, 2' extend. The housing assembly comprises housing blocks 16, 16' which are at least similar to each other and may be identical. Accordingly, the lower block will be described in detail and the structural features of the upper block will be identified with the same reference numerals, differentiated by prime marks.

Figure 2:
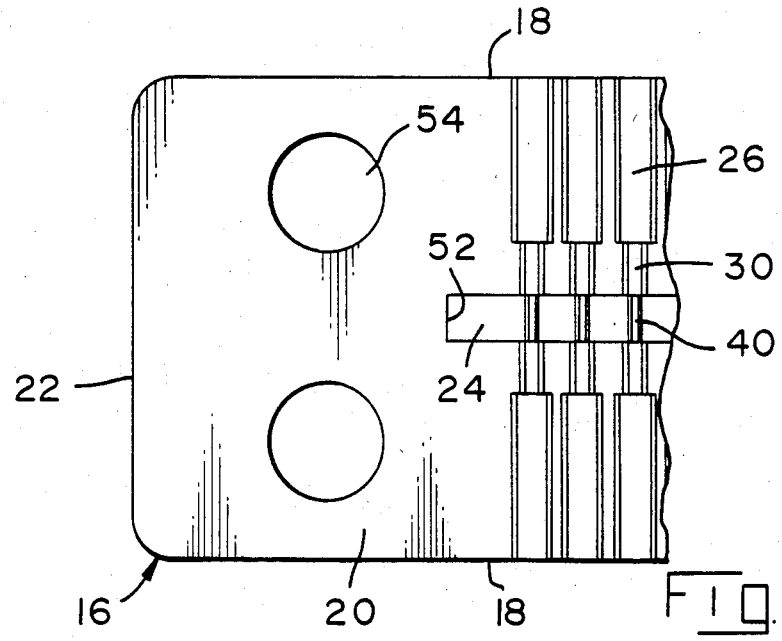
FIG. 2 is a plan view of the mating face of one of the housing blocks of the assembly of FIG. 1.
Figure 3:
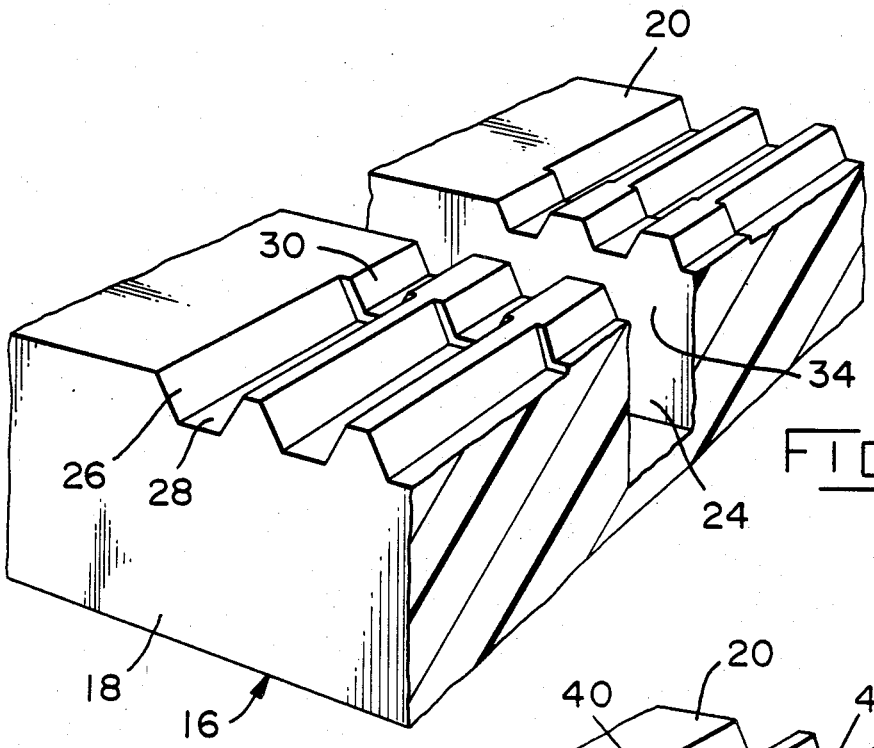
FIG. 3 is a fragmentary perspective view of a central portion of the lower housing block shown in FIG. 1.
Figure 4:
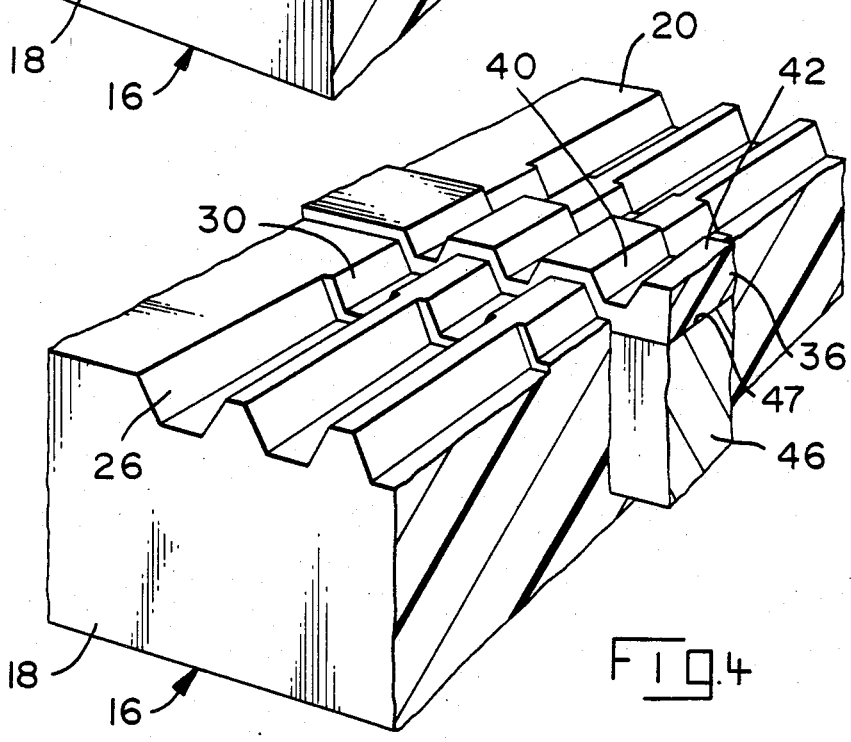
FIGS. 4 and 5 are views similar to FIG. 3 showing additional parts of the connecting device and showing the manner in which the conductors are positioned on the lower housing block.
Figure 7:
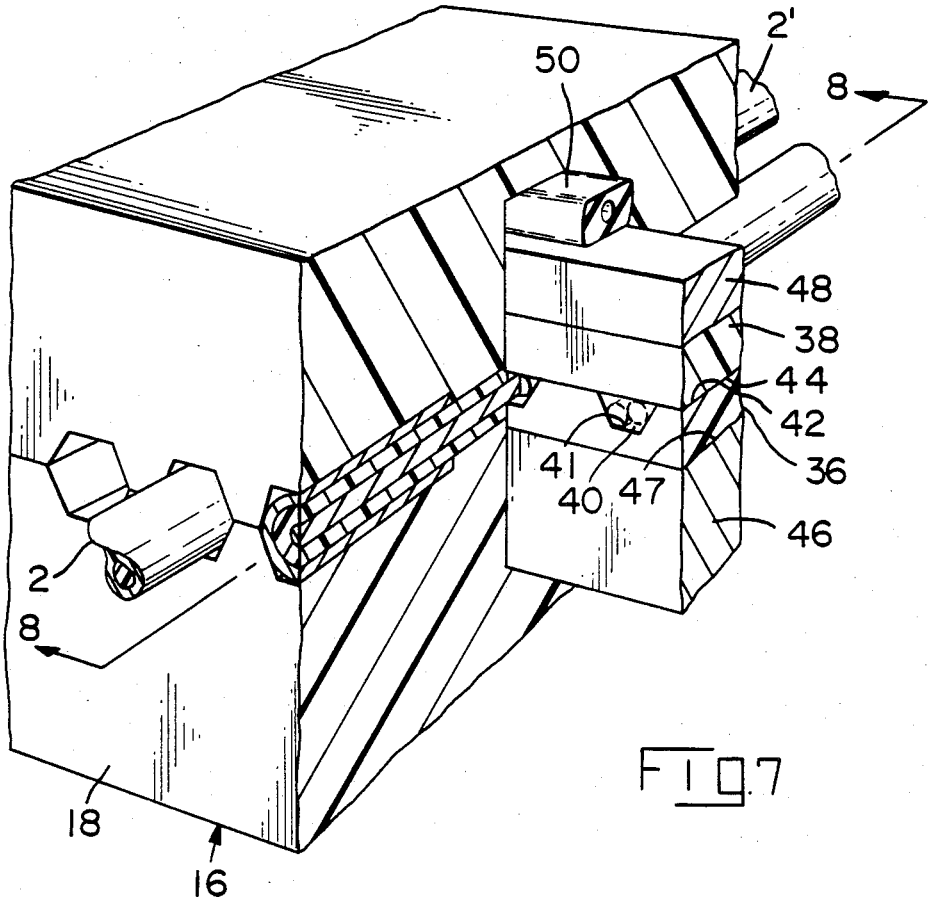
FIG. 7 is a view similar to FIG. 6 showing the upper and lower housing blocks secured to each other in the completed connection.
Figure 8:
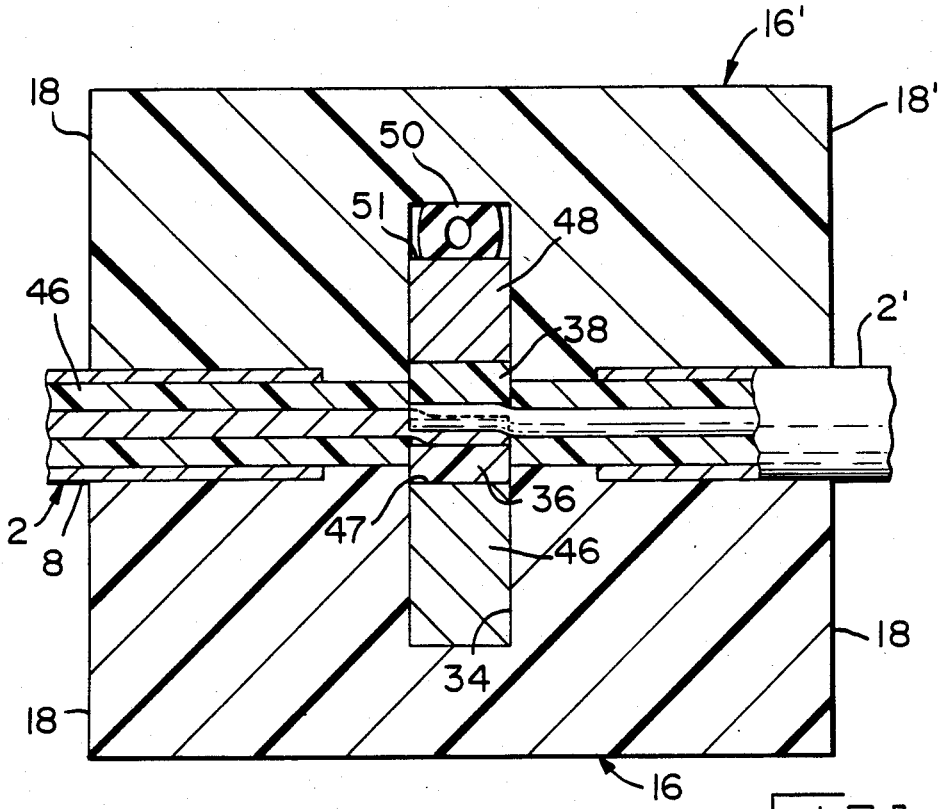
FIG. 8 is a fragmentary sectional side view looking in the direction of the arrows 8—8 of FIG. 7.

The block 16 (FIG. 2) has oppositely facing side surfaces 18 and oppositely facing end surfaces 22 which become the side surfaces and end surfaces respectively, of the housing assembly. A mating face 20 extends normally of the side and end surfaces and has a channel 24 therein which is midway between the side surfaces and has ends 52 which are between the end surfaces 22 so that the ends 52 are spaced from the ends 22 of the block. Grooves 26 are provided in the mating face which extend transversely of, and intersect, the channel 24. Each groove has an inner end or floor 28 (FIGS. 3 through 5) and the depth of the groove and the inclination of its side surfaces is such that when the blocks are against each other, the conductors will be clamped firmly as shown in FIG. 7. Each groove has a reduced cross-sectional portion 30 which is adjacent to the channel 24 and which is dimensioned to receive the unshielded portion 12 of a conductor as shown in FIGS. 7 and 8. The conductors can be placed on the mating surface of the lower block 16 by positioning them in the grooves with the ends of the shielding against the shoulders 32 which are between the reduced cross-sectional portions 30 of the grooves and the deeper portions.

The housing blocks 16, 16' must have conducting surfaces and they can be of metal if desired. Alternatively, these blocks may be of an extremely firm plastic having a metallized surfaces. It can be mentioned at this point that the compressing bars 46, 48 must at least have metallized surfaces and can therefore be of metal or of extremely firm plastic having metallized surfaces.

The sidewalls 34 of the channel 24 are spaced apart by a distance equal to the lengths of the stripped end portions 10 of the conductors so that when the conductors are placed on the block, their stripped ends will overlap and be in alignment with the channel.

Figure 6:
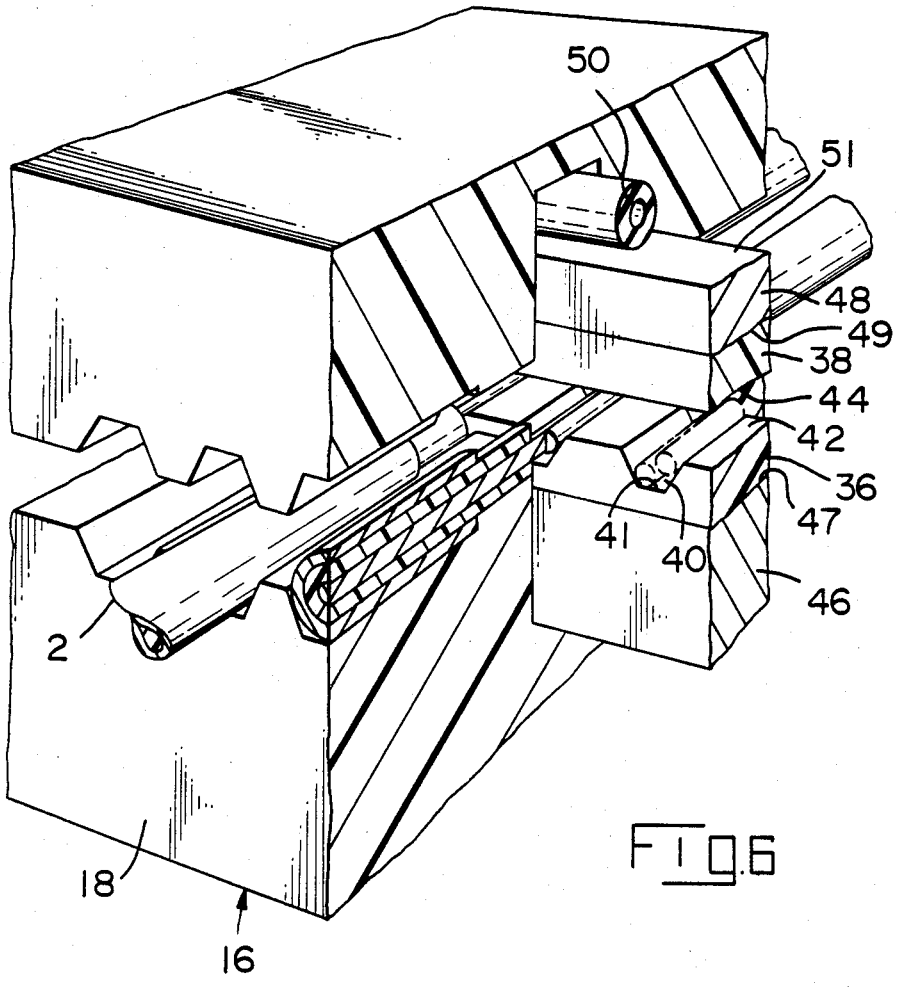
FIG. 6 is a perspective view showing both the lower and upper housing blocks in opposed relationship to each other prior to their being secured to each other.

The lower housing block has a plastic compressing block 36 therein of Teflon or similar material which has a groove 40 on its upper face 42 for reception of the stripped ends as shown in FIG. 6. The depth of the groove 40 is such that when the stripped ends are placed in this groove and against the floor 41 thereof, one of the conductors will extend above the surface 42 as shown in FIG. 6.

Beneath the compressing block 36, a metallic or firm or plastic compressing bar 46 is provided which, as mentioned above, must have metallized surfaces 47 which is against the compressing block 46.

The upper housing 16' has a compressing block 38 therein of the same material as the block 36 but having a rectangular cross section so that its lower surface 44 will be against the surface 42 and will span the recess 40 when the parts are assembled. The compressing bar 48 is metallic or has a metallic surface and has a lower surface 49 which is against the compressing block 38. Finally, a compressible elastomer 50 is provided in the channel of the upper housing block between the inner end of the channel and the upper surface 51 of the compressing bar 38.

To connect the ends of the conductors 2 to the conductors 2', it is merely necessary to place the ends of the conductors in the grooves and recesses of the lower housing 16 and the lower compressing block 36 as shown in FIG. 5. Thereafter, the upper housing 16' and its associated compressing block 38 and compressing bar 48 are assembled to the lower housing by means of fasteners 54 as shown. When the two housing blocks are assembled to each other, the overlapping stripped ends of the conductors will be held firmly against each other to establish electrical contact between these stripped ends.

An important advantage of the invention is that it is possible to achieve an impedance Z' in the connecting zone which is compatible with the characteristic impedance of the conductors connected to each other. The characteristic impedance Z of each of the conductors is determined by the dielectric constant of the insulating material and the distance between the conducting core and the shielding layer. As shown in FIG. 8, the relationships in the cable are continued into the unshielded zone of each conductor by virtue of the fact that the surfaces of the reduced cross section portions 30 of the grooves 26 are against the unshielded portion 12 of each conductor 2, 2'. Therefore, the distance between the center of the conductor, that is the conducting core 4, and the shielding (in this instance the surface of the upper and lower housing blocks), is maintained. In the actual zone of connection the shielding is continued by virtue of the fact that the compressing bars 46, 48 have metallic surfaces 47, 49 and impedance mismatch is avoided by making the compressing blocks 36, 38 of materials which, under the conditions in which they are used, will produce an impedance Z' that is compatible with the impedance of the cable. Again, the impedance in the connecting zone is a function of the thickness of these compressing blocks 36, 38 and their dielectric constant. However, it must be observed that there are two overlapping conductors in the compressing zone and this fact will also effect the impedance characteristics in that zone. The distance between the overlapped conductors and the surfaces of the compressing bars 46, 48 and the dielectric constant of the compressing blocks 36, 38 can be selected to produce the desired impedance characteristcs.

This matched impedance feature of the invention is particularly important in the extremely fine diameter shielded conductors which will come into use in the foreseeable future for the reason that the future generations of computers and similar equipment will be extremely high speed with shorter wavelength pulses than have heretofore been common and with greater possibilities for electronic mischief if impedance matching is not achieved in the electrical connections. The present invention provides the designer of a specific connecting device in accordance with the invention with variables (the thickness of the compressing blocks and the dielectric constant of these blocks) which he varies to match the impedance of the conductors being connected.

Figure 11:
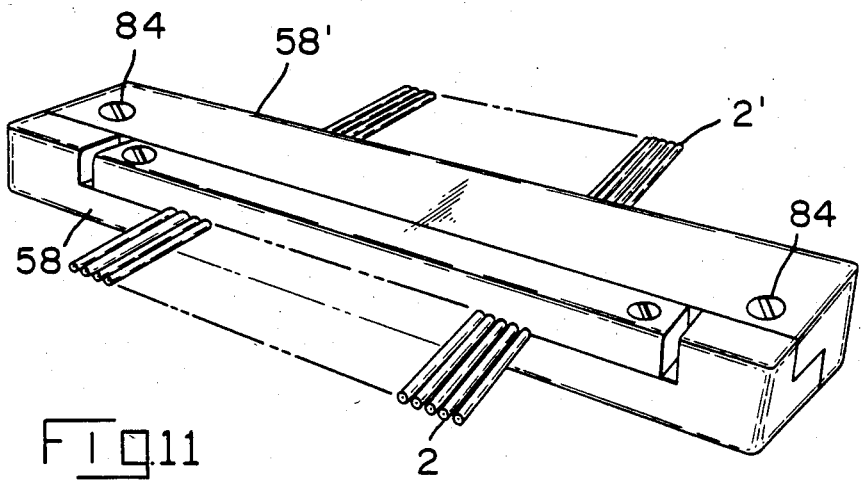
FIG. 11 is a perspective view of the complete connector assembly of FIGS. 9 and 10.
Figure 9:
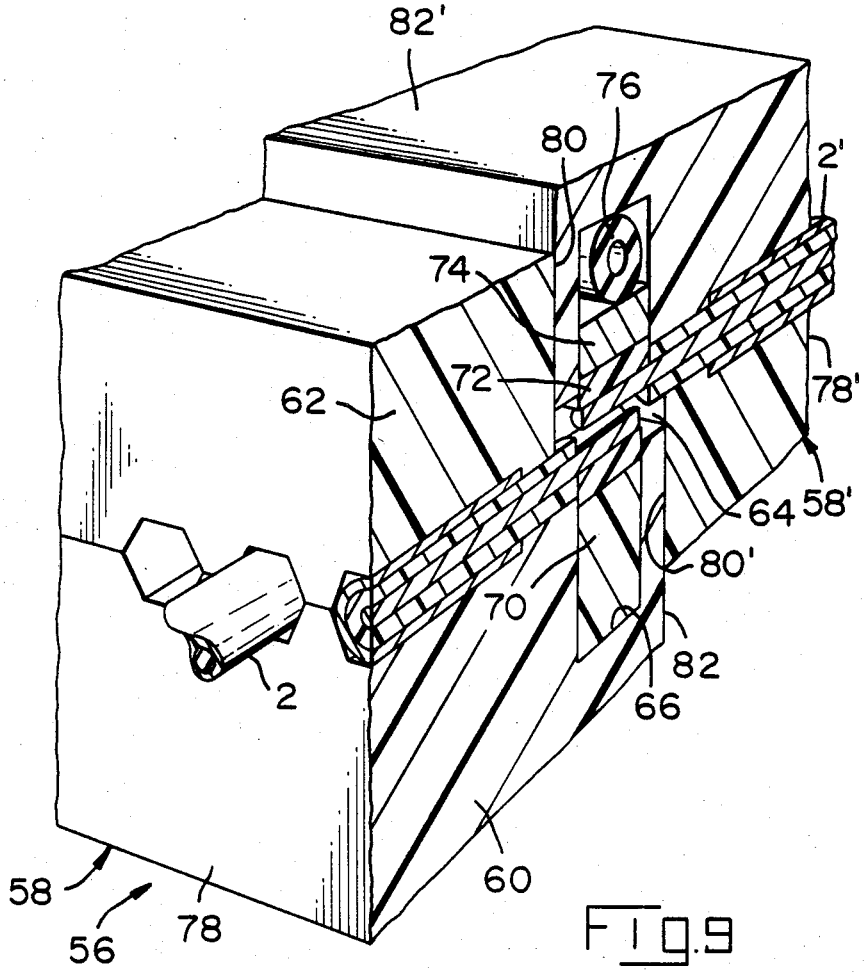
FIG. 9 is a view similar to FIG. 6 but showing an alternative embodiment of the invention.
Figure 10:
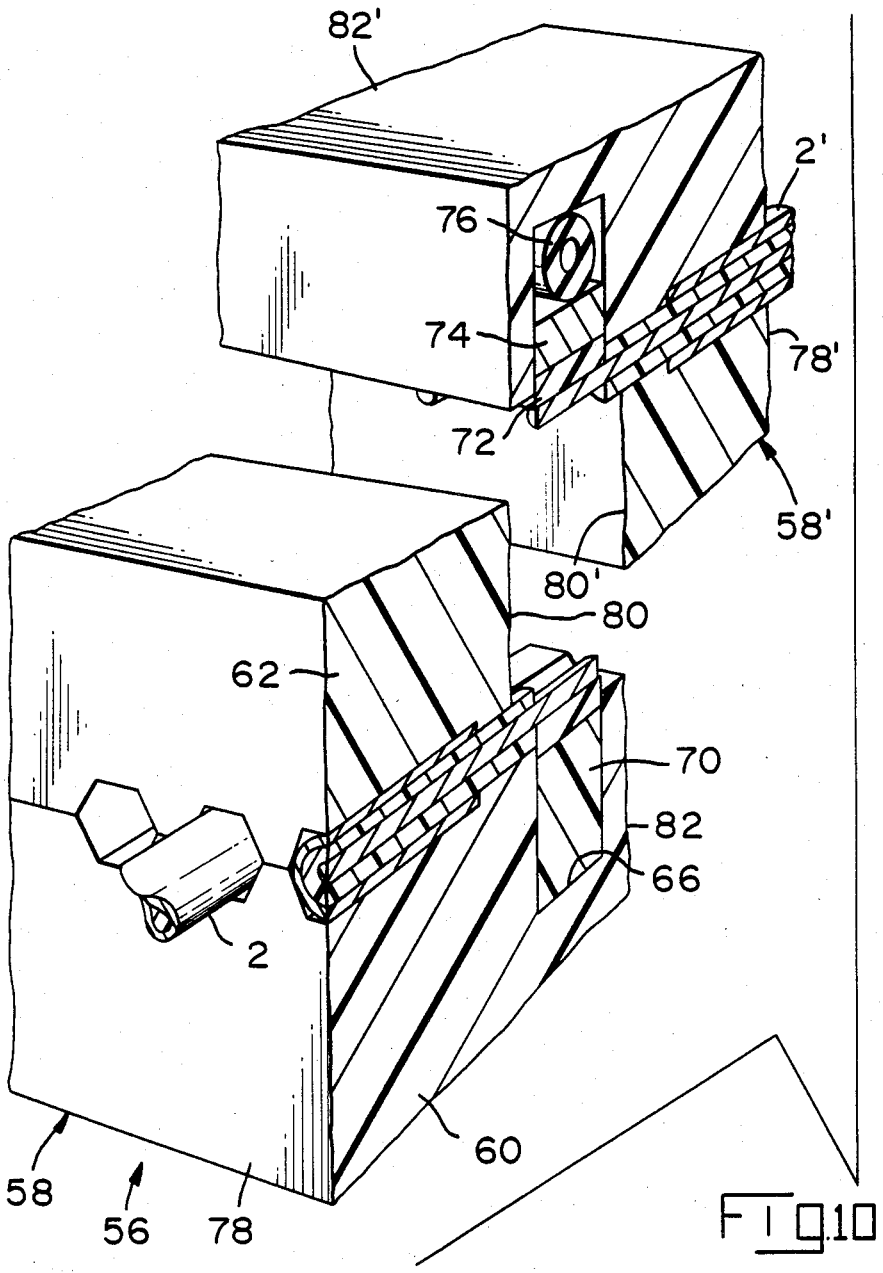
FIG. 10 is a view similar to FIG. 9 but with the parts exploded from each other.

FIGS. 9–11 show an alternative embodiment 56 of the invention which has the advantage that the cables 2 in FIG. 1 can be assembled to one housing subassembly 58, the cables 2' can be assembled to a similar housing subassembly 58' at a different location, and the two subassemblies 58, 58' can then be coupled to each other at a third location, a feature which may be required when parts of a machine are being produced at different locations. The embodiment of FIGS. 9 through 11 is also advantageous for the reason that it permiets servicing of the equipment and/or replacement of a module in the equipment. The embodiment of FIGS. 9–11 has the main features described above and it will only be necessary therefore to describe those features which contribute to the matable aspect of this embodiment.

The connector housing assembly 56, FIG. 9, comprises two subassemblies 58, 58' which again are similar to each other. The subassembly 58 comprises a lower and upper housing block 60, 62 of metal or metallized plastic between which the conductors 2 are clamped in grooves as explained above. The lower block 60 has a projecting ledge having a surface 64 which is in effect the mating surface of the block. The channel 66 is provided in the surface 64 of this ledge and the compressing blocks and pressure-applying blocks 68, 70 are in this channel as explained above. The subassembly 58' is similar excepting that it has the elastomeric compressible member 76 therein for applying pressure to the overlapping stripped ends of the conductors. As shown in FIG. 11, the two parts of each subassembly are secured to each other by fasteners at their ends. In the completed assembly, the surfaces 82, 82' are against the surfaces 80, 80' and in the actual connecting zone, the structural features are the same as those of the previously described embodiment.

We claim:

1. An electrical connection between a first shielded coaxial conductor and a second shielded coaxial conductor, each of the conductors having a circular cross section and comprising a central core, an insulating layer in surrounding relationship to the core, and a metallic shielding layer in surrounding relationship to the insulating layer, each of the conductors having a stripped end portion from which the metallic shielding layer and the insulating layer have been removed so that the central core is exposed, each of the conductors having an unshielded portion from which the shielding layer has been removed so that the insulating layer is exposed, the unshielded portion being next to the stripped end portion, each of the conductors having the same characteristic impedance Z which is a function of the distance d between the central core and the shielding layer and of the dielectric constant of the insulating layer, the electrical connection being characterized in that:

the shielded conductors are in axial alignment with each other and extend towards each other, the stripped end portions being in overlapping parallel relationship and being against each other in a connecting zone, the end portions are surrounded by compressed insulating material, the end portions being pressed against each other by the compressed insulating material, the compressed insulating material being maintained in a compressed condition by compressing means in the connecting zone, the compressing means having opposed parallel conductive surface portions on opposite sides of the stripped ends so that the compressed insulating material is between the opposed conductive surface portions and the overlapping stripped ends, and housing means in surrounding and enclosing relationship to the connecting zone and in surrounding relationship to portions of the first and second conductors, the housing means having metallic shielding surface portions which are in electrical contact with the metallic shielding layers of the first and second conductors and in electrical contact with the parallel conductive surface portions thereby to provide electrical continuity between the shielding layers of the first and second conductors, the compressed insulating material having a thickness d', the thickness d' and the dielectric constant of the compressed insulating material being preselected to produce a characteristic impedance in the connecting zone which is compatible with the characteristic impedance Z of the first and second conductors.

2. An electrical connection as set forth in claim 1 characterized in that the compressed insulating material comprises two compressed blocks of insulating plastic material, the compressed blocks having opposed block surfaces which are compressed against each other, the stripped ends being between the opposed block surfaces.

3. An electrical connection as set forth in claim 2 characterized in that at least one block has a recess therein, the stripped ends being in the recess.

4. An electrical connection as set forth in claim 1 characterized in that the housing means comprises at least two metallic housing blocks, the housing blocks having mating surfaces which are against each other, the mating surfaces having opposed aligned channels therein, the compressed insulating material and the compressing means being in the channels.

5. An electrical connection as set forth in claim 4 characterized in that the compressed insulating material comprises two compressed blocks of plastic insulating material, the compressed blocks having opposed block surfaces which are compressed against each other, the stripped ends being between the opposed block surfaces, the compressing means comprising metallic pressure applying blocks, at least one of the channels having a compressed spring means therein bearing against one of the pressure applying blocks.

6. An electrical connection as set forth in claim 1 characterized in that the housing means comprises at least two metalized plastic housing blocks, the housing blocks having mating surfaces which are against each other, the mating surfaces having opposed aligned channels therein, the compressed insulating material and the compressing means being in the channels.

7. An electrical connection as set forth in claim 6 characterized in that the compressed insulating material comprises two compressed blocks of plastic insulating material, the compressed blocks having opposed block surfaces which are compressed against each other, the stripped ends being between the opposed block surfaces, the compressing means comprising metalized plastic pressure applying blocks, at least one of the channels having a compressed spring means therein bearing against one of the pressure applying blocks.

8. An electrical connector assembly serving to connect each conductor in a first group of shielded coaxial conductors to each conductor in a second group of shielded coaxial conductors, each of the conductors having a circular cross section and comprising a central conductive core, an insulating layer in surrounding relationship to the core, and a metallic shielding layer in surrounding relationship to the insulating layer, each of the conductors having a stripped end portion from which the metallic shielding layer and the insulating layer has been removed so that the central core is exposed, each of the conductors having an unshielded portion from which the shielding layer has been removed so that the insulating layer is exposed, the unshielded portion being next to the stripped end portion, each of the conductors having the same characteristic impedance Z which is a function of the distance d between the central core and the shielding layer and of the dielectric constant of the insulating layer, the electrical connector assembly being characterized in that:

the connector assembly comprises a housing assembly which comprises at least two metallic connector blocks, the connector blocks each having a mating face, the mating faces being against each other, the housing assembly having oppositely facing housing assembly side surfaces which extend normally of the mating faces, the conductors in each of the groups being in side-by-side parallel coplanar aligned relationship, the first and second groups of conductors extending towards each other and into the housing assembly side surfaces so that the unshielded portions and the stripped end portions are between the mating faces, the stripped ends of the conductors in the first and second groups overlapping each other in a connecting zone, the connecting zone being between, and extending parallel to, the housing assembly side surfaces, the mating faces each having a channel extending inwardly therefrom and extending normally of the conductors, the channel encompassing the connecting zone so that the stripped ends are in alignment with the channels, each of the channels having therein compressed insulating material adjacent to the respective mating face and each channel having compressing means therein, the compressing means serving to compress the compressed insulating material and maintain the insulating material against the overlapping stripped ends whereby the stripped ends are pressed against each other and maintained in electrical contact, the compressing means having opposed conductive surface portions which are spaced from the overlapping stripped ends by the thickness of the compressed insulating material, the compressed insulating material having a thickness d', the thickness d' and the dielectric constant of the compressed insulating material being preselected to produce a characteristic impedance in the connecting zone for each connected pair of conductors which is compatible with the characteristic impedance Z of the first and second conductors.

9. An electrical connector assembly as set forth in claim 8 characterized in that the housing assembly has metallic surface portions which are against the shielding layers of the conductors in the first and second groups and against the unshielded portions of the conductors in the first and second groups thereby providing shielding for the unshielded portions and providing electrical continuity between the shielding layers of the conductors in the first and second groups.

10. An electrical connector assembly as set forth in claim 9 characterized in that the compressed insulating material in each channel comprises a continuous body of insulating material extending in its associated channel transversely of the stripped ends, one of the bodies of insulating material having transversely extending grooves therein, each groove containing an overlapping pair of stripped ends.

11. An electrical connector assembly as set forth in claim 10 characterized in that the compressed insulating material in each channel comprises a continuous body of insulating material extending transversely of the stripped ends, the compressing means comprising a rigid compressing bar in each channel and a compressed resilient force applying means in at least one of the channels, the rigid compressing bar in the one channel which contains the force applying means being between the force applying means and the compressed insulating material.

12. An electrical connector assembly as set forth in claim 11 characterized in that the compressed resilient force applying means comprises compressed elastomeric material.

13. An electrical connector assembly as set forth in either of claims 8 or 12 characterized in that the housing assembly comprises two metallic housing blocks which are in opposed aligned relationship, each of the housing blocks having oppositely facing housing block side surfaces, each of the housing assembly side surfaces being comprised of the housing block side surfaces of both of the housing blocks.

14. An electrical connector assembly as set forth in claim 13 characterized in that the conductive core of each of the conductors is a glass fiber having a metallized surface.

15. An electrical connector assembly as set forth in claim 13 characterized in that the channel in each of the housing blocks is parallel to, and substantially midway between, its housing block side surfaces, at least one of the housing blocks having grooves in its mating face extending from its housing block side surfaces to its channel, the conductors in the first group being in the grooves on one side of the channel and the conductors in the second group being in the grooves on the other side of the channel.

16. An electrical connector assembly as set forth in claim 15 characterized in that each of the grooves has a reduced cross section portion extending from its associated channel towards the adjacent housing block side surface, the unshielded portions of the conductors being in the reduced cross section portions.

17. An electrical connector as set forth in claim 15 characterized in that the conductors are clamped in the grooves on the mating face thereby to provide strain relief for the conductors.

18. An electrical connector assembly as set forth in either of claims 8 or 12 characterized in that the housing assembly comprises first and second housing subassemblies, the first group of connectors extending into the first housing subassembly, the second group of conductors extending into the second housing subassembly.

19. An electrical connector assembly as set forth in claim 18 characterized in that the conductive core of each of the conductors is a glass fiber having a metallized surface.

* * * * *